US010608366B1

(12) United States Patent
Liao

(10) Patent No.: US 10,608,366 B1
(45) Date of Patent: Mar. 31, 2020

(54) VEHICLE CHARGER

(71) Applicant: Cheng Uei Precision Industry Co., Ltd., New Taipei (TW)

(72) Inventor: Yi-Ping Liao, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/445,154

(22) Filed: Jun. 18, 2019

(30) Foreign Application Priority Data

Oct. 26, 2018 (CN) ..... 2018 2 1750416 U

(51) Int. Cl.

| | |
|---|---|
| ***H01R 13/44*** | (2006.01) |
| ***H01R 13/506*** | (2006.01) |
| ***H01R 13/15*** | (2006.01) |
| ***H01R 13/68*** | (2011.01) |
| ***H01R 13/66*** | (2006.01) |

(52) U.S. Cl.
CPC ..... *H01R 13/506* (2013.01); *H01R 13/15* (2013.01); *H01R 13/6675* (2013.01); *H01R 13/68* (2013.01)

(58) Field of Classification Search
CPC ..... H01R 10/00; H01R 13/53; H01R 13/04; H01R 13/516; H01T 13/08
USPC ..... 439/125–128; 123/169
See application file for complete search history.

(56) References Cited

U.S. PATENT DOCUMENTS

| | | | | |
|---|---|---|---|---|
| 6,358,071 | B1 * | 3/2002 | Moga | H01T 13/04 439/125 |
| 6,386,893 | B2 * | 5/2002 | Reum | H01T 13/06 439/125 |
| 6,635,605 | B1 * | 10/2003 | Como | C10M 111/04 439/125 |
| 6,668,810 | B1 * | 12/2003 | St. John | F02P 3/02 123/634 |
| 6,682,357 | B2 * | 1/2004 | Sikora | H01R 13/20 439/125 |
| 8,066,520 | B2 * | 11/2011 | Lenfert | H01R 4/2404 439/125 |

* cited by examiner

*Primary Examiner* — Phuong Chi Thi Nguyen
(74) *Attorney, Agent, or Firm* — Cheng-Ju Chiang

(57) ABSTRACT

A vehicle charger includes a base body, a fuse, a positive pole terminal, an elastic element, a voltage transformation unit, a negative connecting component and a front cover. An inside of the base body has an accommodating space. A front end of the base body has a fastening structure. The positive pole terminal is accommodated in the accommodating space and is connected with one end of the fuse. One end of the elastic element is connected with the other end of the fuse. The voltage transformation unit is accommodated in the accommodating space. The other end of the elastic element is connected with the voltage transformation unit. The negative connecting component is electrically connected with the voltage transformation unit. The front cover is detachably mounted to the base body. The front cover has a locking assembly. The locking assembly cooperates with and is buckled with the fastening structure.

20 Claims, 8 Drawing Sheets

VEHICLE CHARGER

CROSS-REFERENCE TO RELATED APPLICATION

The present application is based on, and claims priority form, China Patent Application No. 201821750416.5, filed Oct. 26, 2018, the disclosure of which is hereby incorporated by reference herein in its entirety.

BACKGROUND OF THE INVENTION

1. Field of the Invention

The present invention generally relates to a vehicle charger, and more particularly to a vehicle charger capable of facilitating changing a fuse thereof.

2. The Related Art

With the development of vehicle industries, vehicle chargers used as charging accessories in vehicles are widely utilized to change digital products whenever and wherever for the convenience of vehicle owners.

Multifunctionalities, portabilities, fashions and safeties of the vehicle chargers have become purposes which current various enterprises are eager to achieve. For the safeties, the vehicle chargers are equipped with fuses, when over-voltage currents are overly large, the fuses are automatically burnt out to protect the safeties of the vehicle chargers, but the current vehicle chargers in the market are almost integrally molded. When the fuses are burnt out and the vehicle chargers are incapable of working, the vehicle chargers have no way of being detached automatically and changing the fuses, thus throwing the whole vehicle chargers. In conclusion, a waste phenomenon and an environment pollution phenomenon will be caused, and the waste phenomenon and the environment pollution phenomenon are inconsistent with a protecting environment habit and a diligence and frugality advocated by societies.

Thus, it is especially important to design an innovative vehicle charger which is capable of facilitating changing a fuse of the innovative vehicle charger.

SUMMARY OF THE INVENTION

An object of the present invention is to provide a vehicle charger. The vehicle charger includes a base body, a fuse, a positive pole terminal, an elastic element, a voltage transformation unit, a negative connecting component and a front cover. An inside of the base body has an accommodating space penetrating through middles of a front surface and a rear surface of the base body. A front end of the base body has a fastening structure disposed in a front of the accommodating space. The fuse is accommodated in the accommodating space. The positive pole terminal is accommodated in the accommodating space. The positive pole terminal is connected with one end of the fuse. The elastic element is accommodated in the accommodating space. One end of the elastic element is connected with the other end of the fuse. The voltage transformation unit is accommodated in the accommodating space. The other end of the elastic element is connected with the voltage transformation unit. The voltage transformation unit is connected with the positive pole terminal by virtue of the fuse and the elastic element being connected between the voltage transformation unit and the positive pole terminal. The negative connecting component is accommodated in the accommodating space. The voltage transformation unit is connected with the fuse by virtue of the elastic element. The negative connecting component is electrically connected with the voltage transformation unit. The front cover is detachably mounted to the base body. The fastening structure is matched with the front cover, and the fastening structure is assembled and connected with the front cover. One end of the front cover for connecting with the base body has a locking assembly. The locking assembly cooperates with and is buckled with the fastening structure. The front cover is assembled to the front end of the base body for sealing the accommodating space.

Another object of the present invention is to provide a vehicle charger. The vehicle charger includes an upper shell, a lower shell, a fastening structure, a fuse, a positive pole terminal, an elastic element, a voltage transformation unit, a negative connecting component and a front cover. The lower shell is disposed under the upper shell and matched with the upper shell. The upper shell is fastened on the lower shell, and an accommodating space is formed between the upper shell and the lower shell. The accommodating space penetrates through middles of front surfaces and rear surfaces of the upper shell and the lower shell. The fastening structure is disposed in a front of the accommodating space. The fuse is accommodated in the accommodating space. The positive pole terminal is accommodated in the accommodating space. The positive pole terminal is connected with one end of the fuse. The elastic element is accommodated in the accommodating space. One end of the elastic element is connected with the other end of the fuse. The other end of the elastic element is connected with the voltage transformation unit. The voltage transformation unit is accommodated in the accommodating space. The voltage transformation unit is connected with the positive pole terminal by virtue of the fuse and the elastic element being connected between the voltage transformation unit and the positive pole terminal. The voltage transformation unit is connected with the fuse by virtue of the elastic element. The negative connecting component is accommodated in the accommodating space. The negative connecting component is electrically connected with the voltage transformation unit. The front cover is detachably mounted to the upper shell and the lower shell. The fastening structure is matched with the front cover, and the fastening structure is assembled and connected with the front cover. One end of the front cover for connecting with the upper shell and the lower shell, has a locking assembly. The locking assembly cooperates with and is buckled with the fastening structure. The front cover is assembled to front ends of the upper shell and the lower shell for sealing the accommodating space.

Another object of the present invention is to provide a vehicle charger. The vehicle charger includes a base body, a fuse, a positive pole terminal, an elastic element, a voltage transformation unit, a negative connecting component and a front cover. An inside of the base body has an accommodating space penetrating through middles of a front surface and a rear surface of the base body. A front end of the base body has a fastening structure disposed in a front of the accommodating space. The fuse is accommodated in the accommodating space. The positive pole terminal is accommodated in the accommodating space. The positive pole terminal is connected with one end of the fuse. The elastic element is accommodated in the accommodating space. One end of the elastic element is connected with the other end of the fuse. The voltage transformation unit is accommodated in the accommodating space. The other end of the elastic element is connected with the voltage transformation unit. The voltage transformation unit is connected with the positive pole terminal by virtue of the fuse and the elastic element being connected between the voltage transformation unit and the positive pole terminal. The negative connecting component is accommodated in the accommodating space. The voltage transformation unit is connected with the fuse by virtue of the elastic element. The negative connecting component is electrically connected with the voltage transformation unit. The front cover is detachably mounted to the base body. The fastening structure is matched with the front cover, and the fastening structure is assembled and connected with the front cover. One end of the front cover for connecting with the base body has a locking assembly. The locking assembly cooperates with and is buckled with the fastening structure. The front cover is assembled to the front end of the base body for sealing the accommodating space. The front cover includes a location shaft, the front cover opens a penetrating hole penetrating through a middle of the front cover along an axial direction of the front cover, the penetrating hole is communicated with the accommodating space, the base body is of a hollow barrel shape, the fastening structure includes an isolation board connected with a front of an inner peripheral surface of the hollow barrel-shaped base body, the isolation board opens a through-hole penetrating through a middle of the isolation board, the location shaft is accommodated in the accommodating space through the through-hole, the locking assembly includes at least two buckling blocks protruded outward from a peripheral surface of the location shaft, at least two portions of an inner peripheral surface of the through-hole are recessed outward away from the through-hole to form at least two guiding channels penetrating through a front surface and a rear surface of the isolation board, and matched with the at least two buckling blocks, the location shaft is inserted into the through-hole by virtue of the at least two buckling blocks being corresponding to and passing through the at least two guiding channels, the at least two buckling blocks are deviated from the at least two guiding channels by virtue of rotating the front cover, so that the at least two buckling blocks are buckled to a rear surface of the isolation board, and the front cover is buckled to and connected with the front end of the base body, the front cover is flexibly detached from the base body by virtue of rotating the front cover to make the at least two buckling blocks be corresponding to the at least two guiding channels.

As described above, the front cover is detachably mounted to the base body by virtue of a cooperation between the locking assembly and the fastening structure. When the fuse of the vehicle charger is damaged, the front cover is detached from the base body by virtue of rotating the front cover with the bare hands, so that the damaged fuse is further changed and the whole vehicle charger has no need of being thrown. Moreover, the locking assembly is cooperated with the fastening structure, and the locking assembly is assembled to and connected with the fastening structure to make the front cover fastened to the base body. As a result, the vehicle charger is capable of facilitating changing the fuse of the vehicle charger.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
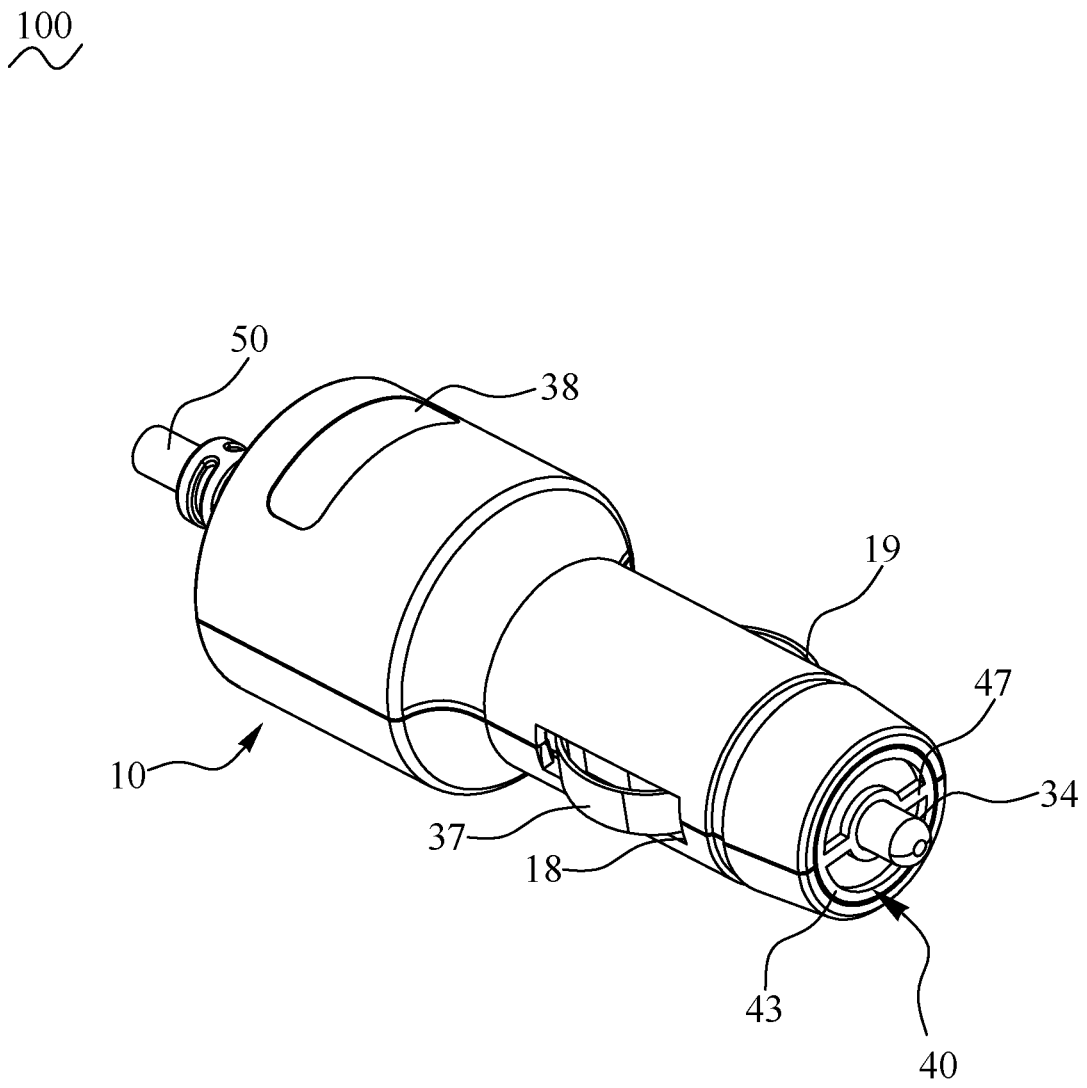
FIG. 1 is a perspective view of a vehicle charger in accordance with a preferred embodiment of the present invention.
Figure 2:
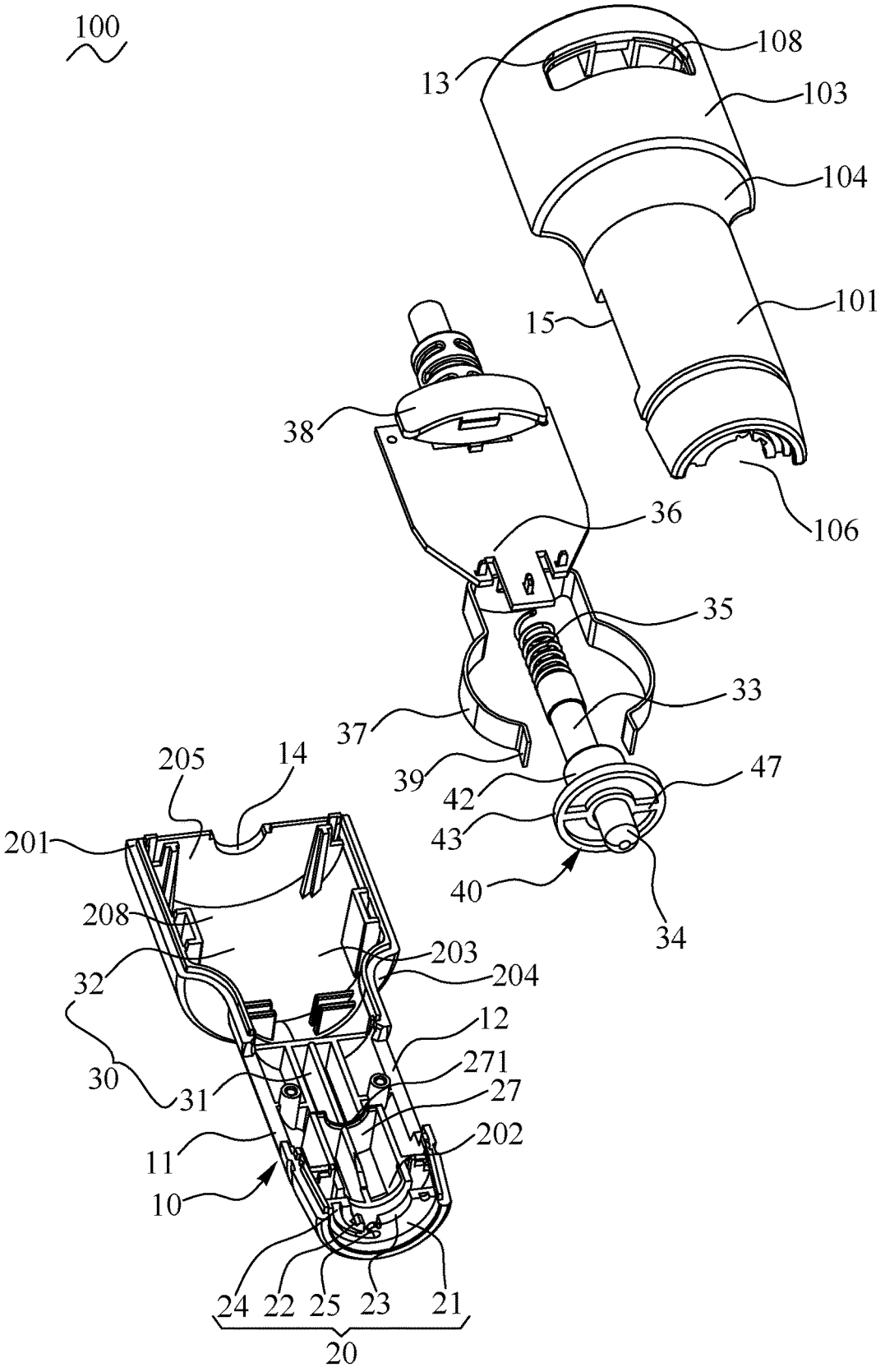
FIG. 2 is an exploded view of the vehicle charger of FIG. 1.
Figure 3:
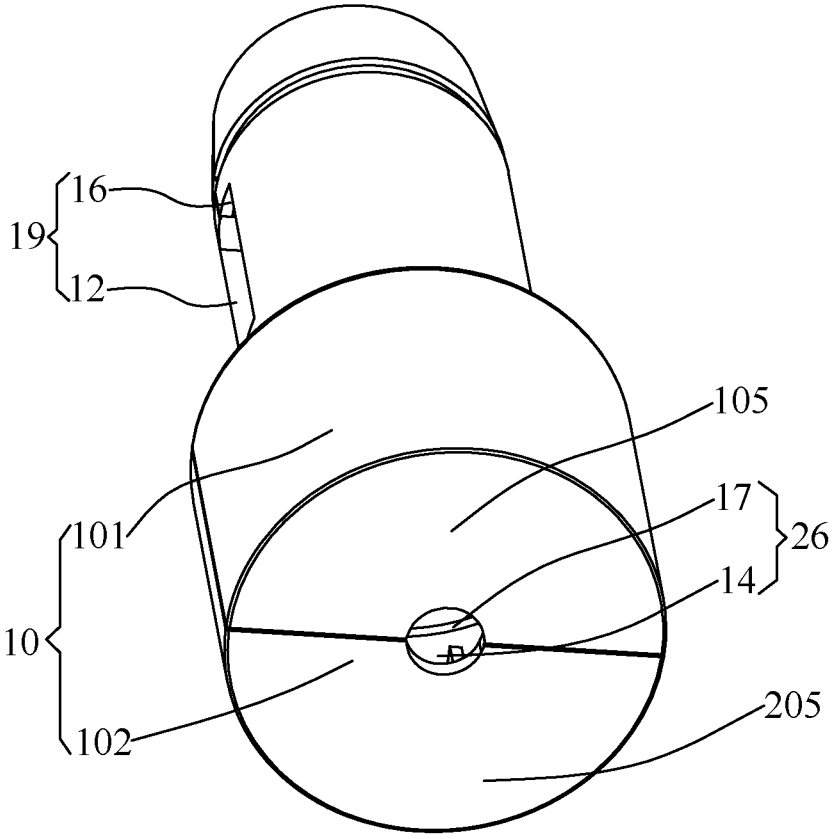
FIG. 3 is a perspective view of a base body of the vehicle charger of FIG. 2.
Figure 4:
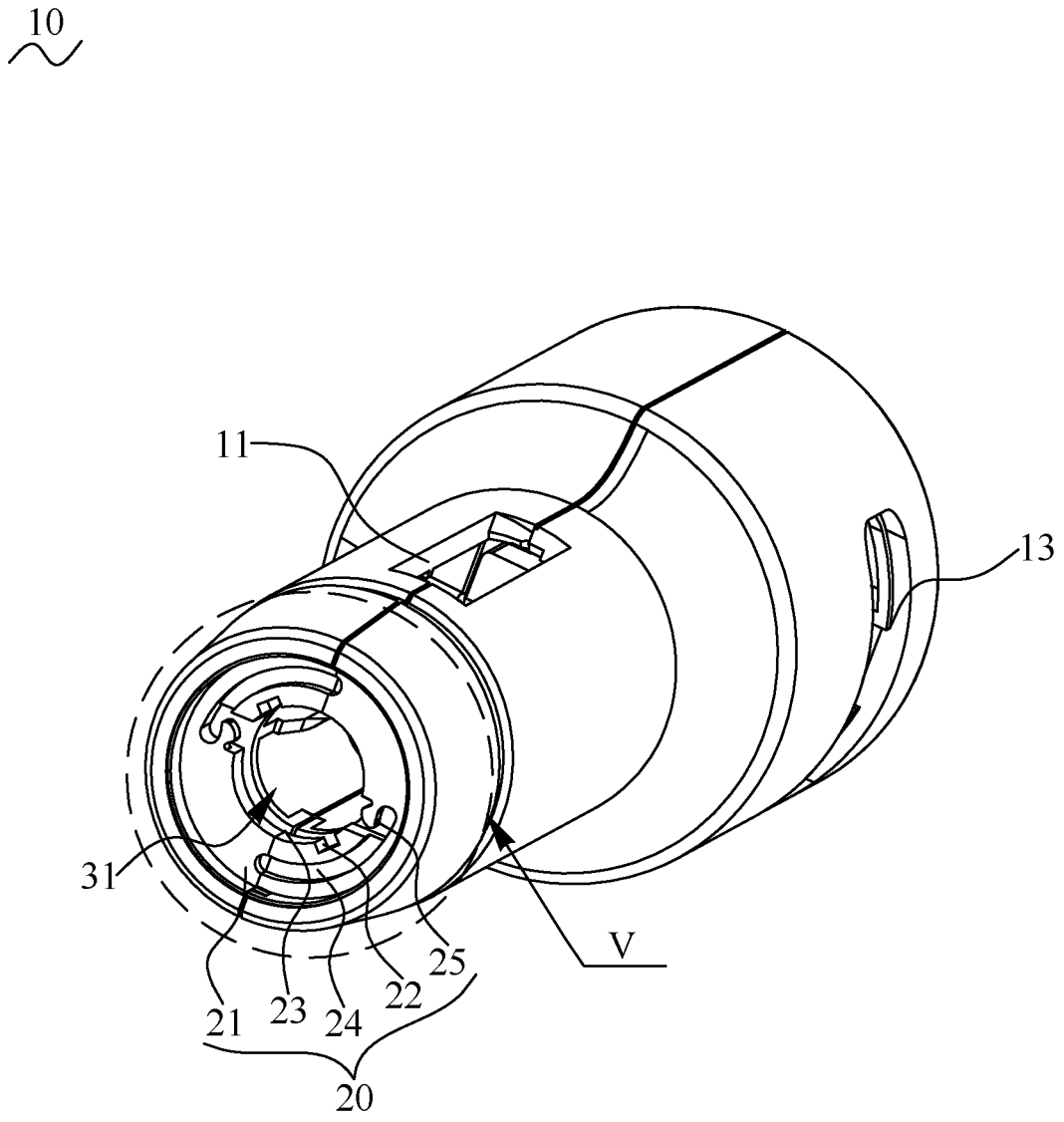
FIG. 4 is another perspective view of the base body of the vehicle charger of FIG. 2.
Figure 5:
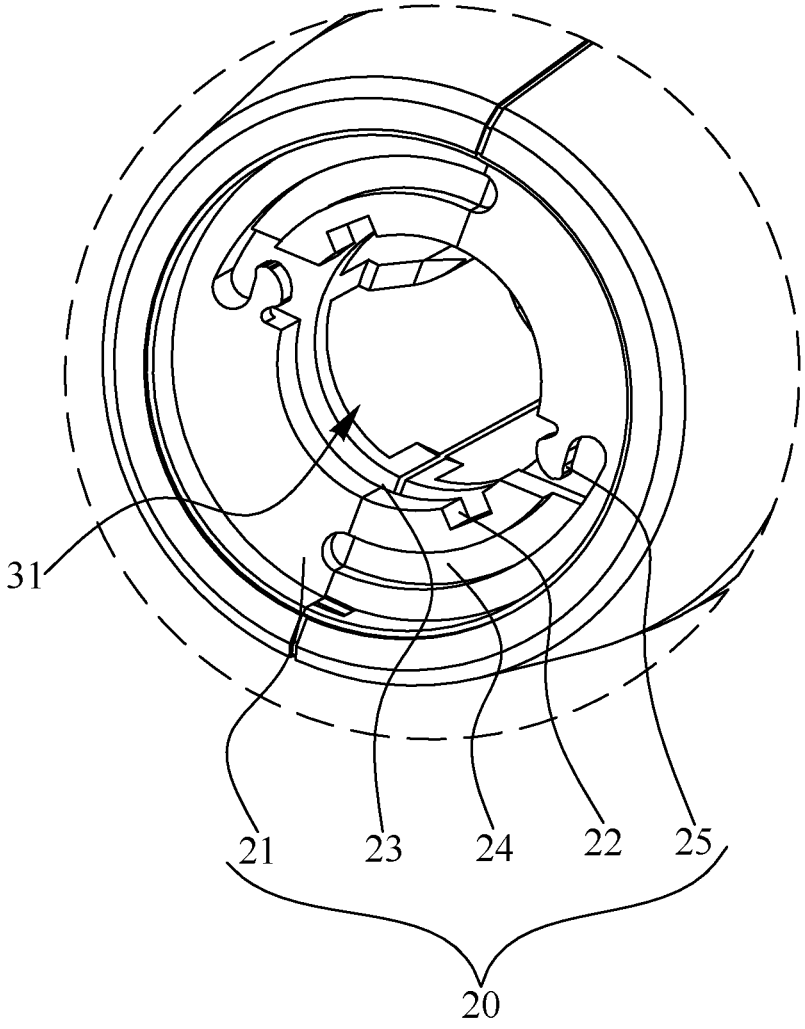
FIG. 5 is an enlarged view of an encircled portion V of the vehicle charger of FIG. 4.
Figure 6:
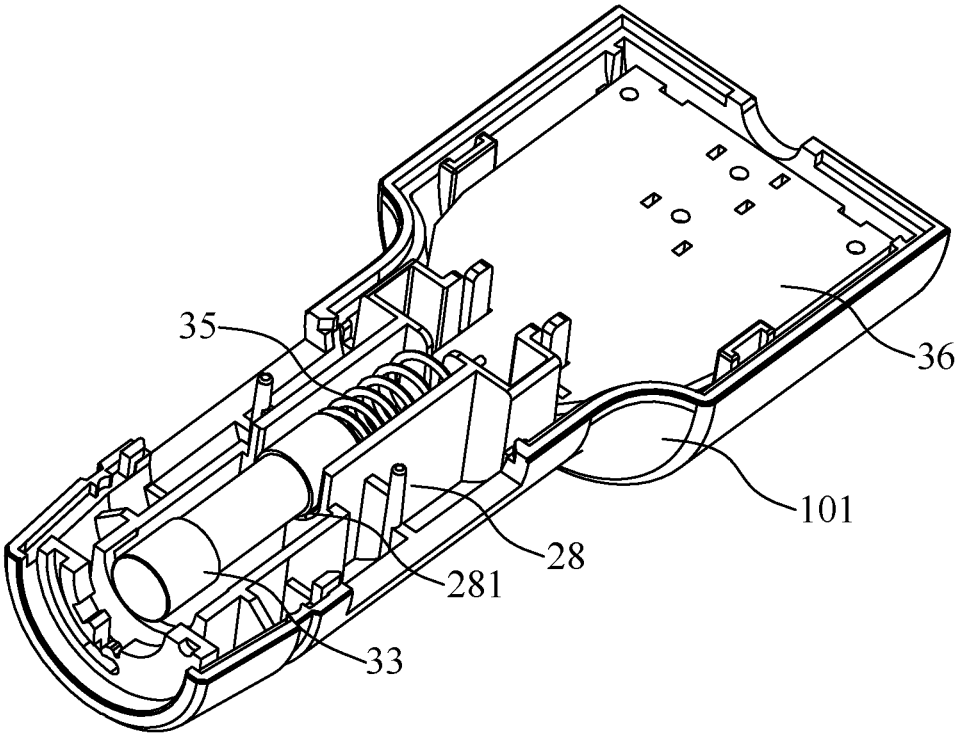
FIG. 6 is a partially perspective view of the vehicle charger showing a fuse, an elastic element, a voltage transformation unit and an upper shell of the vehicle charger of FIG. 2.
Figure 7:
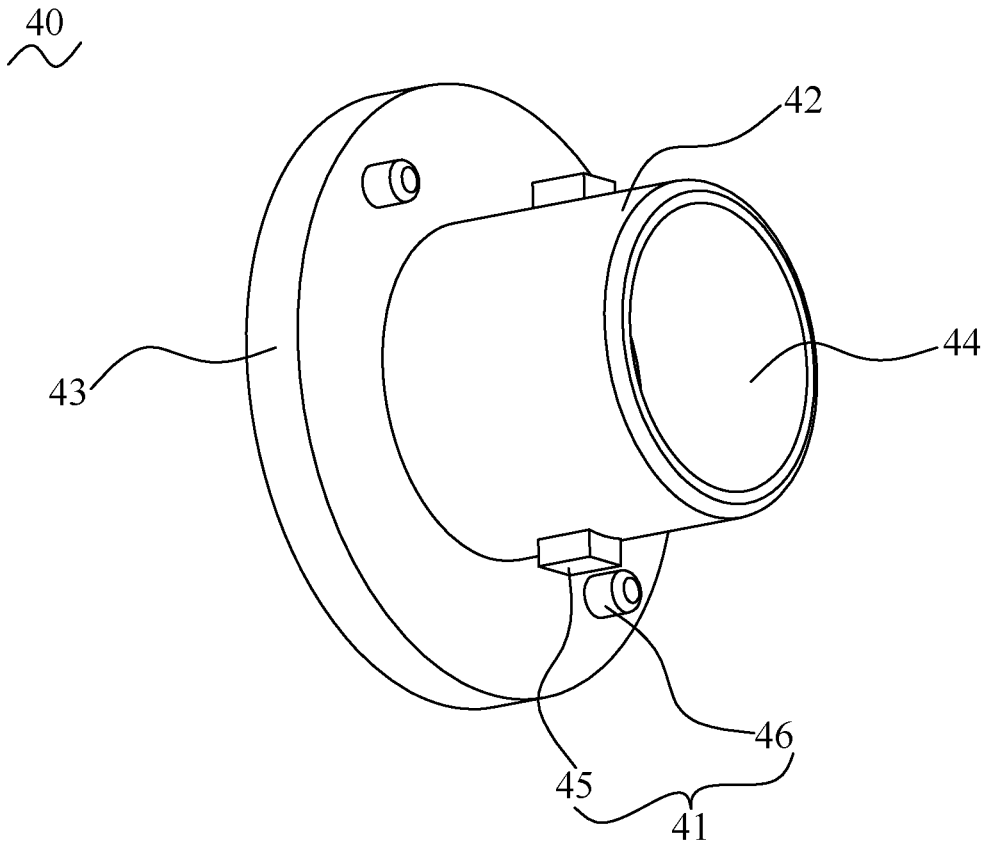
FIG. 7 is a perspective view of a front cover of the vehicle charger of FIG. 2.
Figure 8:
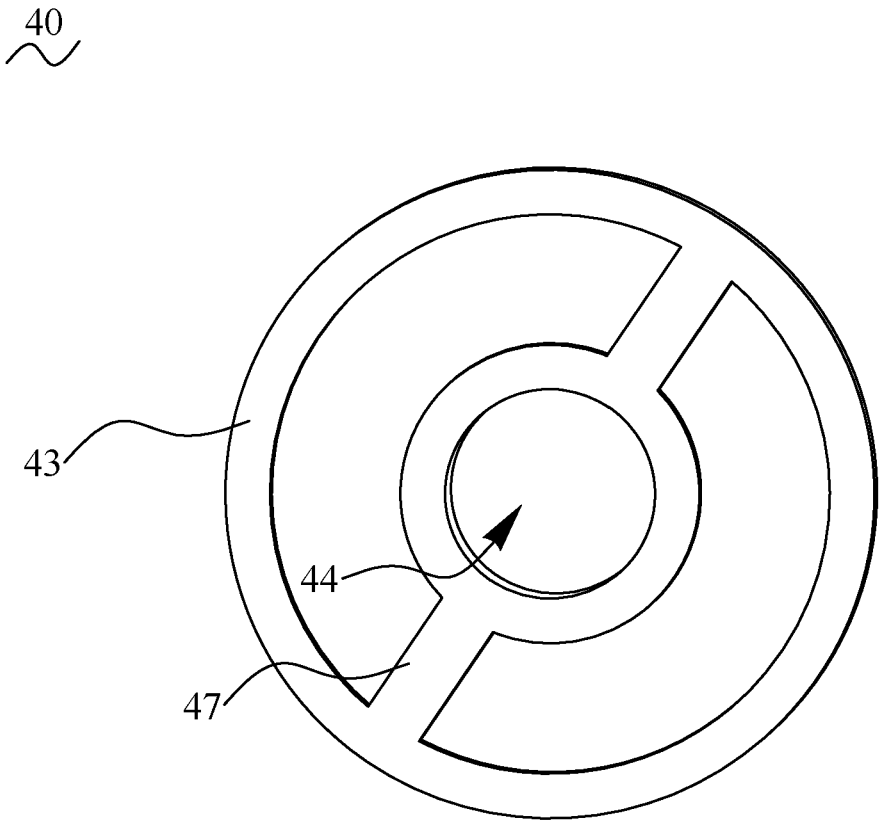
FIG. 8 is a front view of the front cover of the vehicle charger of FIG. 7.

With reference to FIG. 1 and FIG. 2, a vehicle charger 100 in accordance with a preferred embodiment of the present invention is shown. The vehicle charger 100 is adapted for facilitating changing a fuse 33 of the vehicle charger 100. The vehicle charger 100 includes a base body 10, a front cover 40 detachably mounted to the base body 10, a fuse 33, a positive pole terminal 34, an elastic element 35, a voltage transformation unit 36, a negative connecting component 37 and a display element 38.

Referring to FIG. 1 to FIG. 5, the base body 10 is of a hollow barrel shape. The base body 10 is disposed longitudinally and extends in an axis direction of the base body 10. An inside of the base body 10 has an accommodating space 30 penetrating through middles of a front surface and a rear surface of the base body 10. In the preferred embodiment, the accommodating space 30 includes a first accommodating space 31 and a second accommodating space 32. The first accommodating space 31 is disposed at a front end of the inside of the base body 10 to which the front cover 40 is connected, and the second accommodating space 32 is disposed at a rear end of the inside of the base body 10 and connected with a rear end of the first accommodating space 31.

In the preferred embodiment, the fuse 33, the positive pole terminal 34 and the elastic element 35 are accommodated in the first accommodating space 31 of the accommodating space 30. The positive pole terminal 34 is connected with one end of the fuse 33, and one end of the elastic element 35 is connected with the other end of the fuse 33. The voltage transformation unit 36, the negative connecting component 37 and the display element 38 are accommodated in the second accommodating space 32 of the accommodating space 30. The other end of the elastic element 35 is connected with the voltage transformation unit 36. The voltage transformation unit 36 is connected with the positive pole terminal 34 by virtue of the fuse 33 and the elastic element 35 being connected between the voltage transformation unit 36 and the positive pole terminal 34. The negative connecting component 37 is electrically connected with the voltage transformation unit 36. The display element 38 is connected with a top surface of the voltage transformation unit 36, and a plurality of electric wires 50 are connected with the voltage transformation unit 36. The negative connecting component 37 is of a U shape. A mouth of the negative connecting component 37 faces frontward. Two opposite sides of the negative connecting component 37 are arched oppositely outward. The fuse 33 and the elastic element 35 are located between the two opposite sides of the negative connecting component 37. Free ends of the two opposite sides of the negative connecting component 37 extend frontward to form two blocking pieces 39. The voltage transformation unit 36 is connected with the elastic element 35. The voltage transformation unit 36 is connected with the fuse 33 by virtue of the elastic element 35. In the preferred embodiment, the voltage transformation unit 36 is a circuit board.

Referring to FIG. 1 to FIG. 6, the base body 10 is divided into an upper shell 101, and a lower shell 201 disposed under the upper shell 101 and matched with the upper shell 101. A middle of a bottom of the upper shell 101 is opened freely. A front of the upper shell 101 is of an arc shape from a front view. A middle of the front of the upper shell 101 is arched upward to form a first upper space 106 penetrating through a bottom of the middle of the front of the upper shell 101. A rear of the upper shell 101 is of a hollow semicolumn shape. The rear of the upper shell 101 has an arc-shaped upper wall 103, a first front wall 104 and a first rear wall 105. A front end and a rear end of the upper wall 103 are connected with a top of the first front wall 104 and a top of the first rear wall 105.

A tail end of the front of the upper shell 101 is connected with a bottom of the first front wall 104 of the rear of the upper shell 101. The rear of the upper shell 101 has a second upper space 108 penetrating through a bottom of a middle of the rear of the upper shell 101, and surrounded among the upper wall 103, the first front wall 104 and the first rear wall 105. Bottom surfaces of two sides of the front of the upper shell 101 are recessed upward to form a first upper notch 15 and a second upper notch 16. The first upper notch 15 and the second upper notch 16 are symmetrical to a center axis of the upper shell 101. The first upper notch 15 and the second upper notch 16 are communicated with the first upper space 106 of the first accommodating space 31. A bottom surface of the first rear wall 105 of the rear of the upper shell 101 is recessed upward to form a semicircle-shaped first hole 17 communicated with the second upper space 108 of the second accommodating space 32. The upper wall 103 of the rear of the upper shell 101 opens an arc-shaped receiving groove 13 transversely extending and arched upward. The receiving groove 13 penetrates through the upper wall 103 along an up-down direction, and the receiving groove 13 is communicated with the second accommodating space 32. A bottom of the front of the upper shell 101 protrudes downward to form a hollow rectangular fixing frame 28. A bottom, a front and a rear of the hollow fixing frame 28 is opened freely to form a fixing groove 281 inside the fixing frame 28. A bottom surface of the front of the fixing frame 28 is arched upward to form an arc-shaped first locating groove 281. An upper portion of the fuse 33 is located in the first locating groove 281. The elastic element 35 is fixed in the fixing groove 281 of the fixing frame 28. The other end of the elastic element 35 is connected with the voltage transformation unit 36 through the rear of the hollow fixing frame 28.

A middle of a top of the lower shell 201 is opened freely. Top surfaces of two sides of a front of the lower shell 201 are recessed downward to form a first lower notch 11 and a second lower notch 12. The first lower notch 11 and the second lower notch 12 are symmetrical to a center axis of the lower shell 201. A middle of a top of the lower shell 201 is opened freely. A front of the lower shell 201 is of an arc shape from a front view. A middle of the front of the lower shell 201 is arched downward to form a first lower space 202 penetrating through a top of the middle of the front of the lower shell 201. A rear of the lower shell 201 is of the hollow semicolumn shape. The rear of the lower shell 201 has an arc-shaped lower wall 203, a second front wall 204 and a second rear wall 205. A front end and a rear end of the lower wall 203 are connected with a bottom of the second front wall 204 and a bottom of the second rear wall 205. A top of the front of the lower shell 201 protrudes upward to form a propping board 27. A middle of a top of the propping board 27 is recessed downward to form an arc-shaped second locating groove 271. A lower portion of the fuse 33 is located in the second locating groove 271.

A tail end of the front of the lower shell 201 is connected with a top of the second front wall 204 of the rear of the lower shell 201. The rear of the lower shell 201 has a second lower space 208 penetrating through a top of a middle of the rear of the lower shell 201, and surrounded among the lower wall 203, the second front wall 204 and the second rear wall 205. The first lower notch 11 and the second lower notch 12 are communicated with the first lower space 202 of the first accommodating space 31. A top surface of the second rear wall 205 of the rear of the lower shell 201 is recessed downward to form a semicircle-shaped second hole 14 communicated with the second lower space 208 of the second accommodating space 32.

Referring to FIG. 1 to FIG. 8, when the vehicle charger 100 is assembled, the upper shell 101 is fastened on the lower shell 201, and the accommodating space 30 is formed between the upper shell 101 and the lower shell 201. The accommodating space 30 penetrates through middles of front surfaces and rear surfaces of the upper shell 101 and the lower shell 201. The first lower notch 11 is corresponding to the first upper notch 15, and the second lower notch 12 is corresponding to the second upper notch 16. The first lower notch 11 is combined with the first upper notch 15 to form a first opening 18 communicated with the accommodating space 30, and the second lower notch 12 is combined with the second upper notch 16 to form a second opening 19 communicated with the accommodating space 30. The first upper space 106 is combined with the first lower space 202 to form the first accommodating space 31. The second upper space 108 is combined with the second lower space 208 to form the second accommodating space 32. The negative connecting component 37 is mounted between the upper shell 101 and the lower shell 201. The first hole 17 is combined with the second hole 14 to form a circular insertion hole 26 communicated with the second accommodating space 32.

The two opposite sides of the negative connecting component 37 project out of the first opening 18 and the second opening 19, respectively, so that the two opposite sides of the negative connecting component 37 is exposed out of the base body 10. The two blocking pieces 39 are blocked by inner surfaces of the two sides of the front of the lower shell 201 and the two sides of the front of the upper shell 101, and the two blocking pieces 39 are blocked by and buckled in inner surfaces of a front end of the base body 10 which is of the hollow barrel shape, so the two opposite sides of the negative connecting component 37 are fastened to the front end of the base body 10. The display element 38 is exposed out of the base body 10 from the receiving groove 13. A top surface of the display element 38 is smoothly connected with and in alignment with a rear of a surface of the base body 10. The plurality of the electric wires 50 project out of the base body 10 from the insertion hole 26.

Referring to FIG. 1 to FIG. 8, the front cover 40 is detachably mounted to the upper shell 101 and the lower shell 201. The front cover 40 is assembled to front ends of the upper shell 101 and the lower shell 201 for sealing the accommodating space 30. One end of the front cover 40 for connecting with the upper shell 101 and the lower shell 201 of the base body 10 has a locking assembly 41. The front end of the base body 10 has a fastening structure 20 disposed in a front of the accommodating space 30. The front ends of the upper shell 101 and the lower shell 201 have the fastening structure 20. The fastening structure 20 is matched with the front cover 40, and the fastening structure 20 is assembled and connected with the front cover 40. The fastening structure 20 is disposed in a front of the first accommodating space 31 and is matched with the locking assembly 41 of the front cover 40. The locking assembly 41 cooperates with and is buckled with the fastening structure 20. In the preferred embodiment, the front cover 40 includes a location shaft 42, and a cap 43 connected around the location shaft 42 and perpendicular to the location shaft 42. The front cover 40 opens a penetrating hole 44 penetrating through a middle of the front cover 40 along an axial direction of the front cover 40. The front cover 40 opens the penetrating hole 44 penetrating through middles of the location shaft 42 and the cap 43 along the axial direction of the front cover 40. The locking assembly 41 includes at least two buckling blocks 45 protruded outward from a peripheral surface of the location shaft 42. In the preferred embodiment, the locking assembly 41 includes two buckling blocks 45 protruded outward from two sides of the peripheral surface of the location shaft 42. The two buckling blocks 45 are symmetrical to each other with respect to the location shaft 42. The locking assembly 41 includes at least two fixing pillars 46 protruded rearward from a rear surface of the cap 43 facing the isolation board 21. In the preferred embodiment, the locking assembly 41 includes two fixing pillars 46 symmetrical to each other with respect to the location shaft 42.

The fastening structure 20 includes an isolation board 21 connected with a front of an inner peripheral surface of the hollow barrel-shaped base body 10. The first accommodating space 31 of the accommodating space 30 is isolated from an outside space by the isolation board 21. A middle of the isolation board 21 opens a through-hole 23 penetrating through the middle of the isolation board 21. At least two portions of an inner peripheral surface of the through-hole 23 are recessed outward away from the through-hole 23 to form at least two guiding channels 22 penetrating through a front surface and a rear surface of the isolation board 21, and matched with the at least two buckling blocks 45. In the preferred embodiment, two portions of the inner peripheral surface of the through-hole 23 are recessed oppositely to form two guiding channels 22 matched with the two buckling blocks 45. The two guiding channels 22 are symmetrical to each other with respect to a central axis of the base body 10. At least two sides of the front surface of the isolation board 21 are recessed rearward to form at least two arc-shaped sliding slots 24. In the preferred embodiment, two sides of the front surface of the isolation board 21 are recessed rearward to form two arc-shaped sliding slots 24 symmetrical to each other with respect to the through-hole 23. An inner side wall of one end of each sliding slot 24 adjacent to the first accommodating space 31 of the accommodating space 30 is stretched into each sliding slot 24 to form a hook arc 25. The two hook arcs 25 of the two sliding slots 24 are symmetrical to each other with respect to the through-hole 23.

When the front cover 40 is assembled to the front end of the base body 10 for sealing the accommodating space 30, the locking assembly 41 is cooperated with the fastening structure 20, and the locking assembly 41 is assembled to and connected with the fastening structure 20. The rear surface of the cap 43 faces towards the isolation board 21 of the base body 10. The location shaft 42 is inserted into and passes through the through-hole 23 by virtue of the at least two buckling blocks 45 being corresponding to and passing through the at least two guiding channels 22, after the location shaft 42 passes through the through-hole 23 to be inserted into the first accommodating space 31 of the accommodating space 30, the at least two buckling blocks 45 are deviated from the at least two guiding channels 22 by virtue of rotating the front cover 40, so that the at least two buckling blocks 45 are buckled to the rear surface of the isolation board 21, and the front cover 40 is buckled to and connected with the front end of the base body 10.

In the preferred embodiment, the location shaft 42 is inserted into the through-hole 23 by virtue of the two buckling blocks 45 being corresponding to and passing through the two guiding channels 22, after the location shaft 42 passes through the through-hole 23 to be inserted into the first accommodating space 31 of the accommodating space 30, the two buckling blocks 45 are deviated from the two guiding channels 22 by virtue of rotating the front cover 40, so that the two buckling blocks 45 are buckled to the rear surface of the isolation board 21, and the front cover 40 is buckled to and connected with the front end of the base body 10. The location shaft 42 is accommodated in the first accommodating space 31 of the accommodating space 30 through the through-hole 23. The cap 43 is covered to the isolation board 21. The penetrating hole 44 is communicated with the first accommodating space 31 of the accommodating space 30. The positive pole terminal 34 is exposed out of the front cover 40 through the penetrating hole 44 and projects beyond a front surface of the front cover 40. The positive pole terminal 34 keeps being connected with the one end of the fuse 33 by virtue of the elastic element 35 elastically abutting against the fuse 33.

The front cover 40 is capable of flexibly being detached from the base body 10 by virtue of a design cooperation of the at least two buckling blocks 45 and the at least two guiding channels 22. The front cover 40 is flexibly detached from the base body 10 by virtue of rotating the front cover 40 to make the at least two buckling blocks 45 be corresponding to the at least two guiding channels 22, so that the positive pole terminal 34 is facilitated for being detached, and the fuse 33 is facilitated for being changed. After the fuse 33 is changed, the at least two buckling blocks 45 are deviated from the at least two guiding channels 22 by virtue of rotating the front cover 40, the at least two buckling blocks 45 are further buckled to the rear surface of the isolation board 21, and the front cover 40 is buckled to and connected with the front end of the base body 10 again. In the preferred embodiment, the front cover 40 is capable of flexibly being detached from the base body 10 by virtue of a design cooperation of the two buckling blocks 45 and the two guiding channels 22, so that the positive pole terminal 34 is facilitated for being detached, and the fuse 33 is facilitated for being changed. After the fuse 33 is changed, the two buckling blocks 45 are deviated from the two guiding channels 22 by virtue of rotating the front cover 40, the two buckling blocks 45 are further buckled to the rear surface of the isolation board 21, and the front cover 40 is buckled to and connected with the front end of the base body 10 again.

Referring to FIG. 1 to FIG. 8 again, in order to avoid the at least two buckling blocks 45 from being corresponding to the at least two guiding channels 22 again on account of the front cover 40 rotating accidentally, and then the front cover 40 is detached from the front end of the base body 10 accidentally, the at least two fixing pillars 46 slide in the at least two arc-shaped sliding slots 24 to make the at least two fixing pillars 46 limited in the ends of the at least two sliding slots 24 adjacent to the at least two hook arcs 25 by the at least two hook arcs 25. In the preferred embodiment, in order to avoid the two buckling blocks 45 from being corresponding to the two guiding channels 22 again on account of the front cover 40 rotating accidentally, and then the front cover 40 is detached from the front end of the base body 10 accidentally, the two fixing pillars 46 slide in the two arc-shaped sliding slots 24 to make the two fixing pillars 46 limited in the two ends of the two sliding slots 24 adjacent to the two hook arcs 25 by the two hook arcs 25.

The front cover 40 is further fastened in the front end of the base body 10. The at least two buckling blocks 45 are buckled to the rear surface of the isolation board 21, and the front cover 40 is further buckled to and connected with the front end of the base body 10. So each fixing pillar 46 is fastened to one end of one sliding slot 24 by virtue of each fixing pillar 46 being limited in the one end of the one sliding slot 24 adjacent to the hook arc 25 of the one sliding slot 24 by the hook arc 25 of the one sliding slot 24. Thus the front cover 40 is uneasily detached from the base body 10 mistakenly on account of an accident rotation of the front cover 40. The front cover 40 is rotated approximately 90 degrees in a process of each fixing pillar 46 sliding from the one end of the one sliding slot 24 adjacent to the hook arc 25 of the one sliding slot 24 to the other end of the one sliding slot 24.

In addition, in a process of the front cover 40 being detached from the base body 10, the at least two buckling blocks 45 are corresponding to the at least two guiding channels 22, the at least two fixing pillars 46 are slidably located at the other ends of the at least two arc-shaped sliding slots 24 away from the at least two hook arcs 25, so the front cover 40 is detached from the front end of the base body 10 successfully. In the preferred embodiment, the two buckling blocks 45 are corresponding to the two guiding channels 22, the two fixing pillars 46 are slidably located at the other ends of the two arc-shaped sliding slots away from the two hook arcs 25, so the front cover 40 is detached from the front end of the base body 10.

In the preferred embodiment, in order to facilitate detaching the front cover 40 from the front end of the base body 10 with bare hands, or assembling and connecting the front cover 40 to the front end of the base body 10. So a front surface of the cap 43 protrudes frontward to form a holding portion 47 located at two sides of the front surface of the cap 43 and connected with two sides of a front end of the location shaft 42. Two portions of the holding portion 47 located at the two sides of the front surface of the cap 43 are symmetrical to each other with respect to the penetrating hole 44. Hold the holding portion 47 with a bare hand to rotate the holding portion 47, so that the front cover 40 is easily fastened to and connected with, or detached from the base body 10.

As described above, the front cover 40 is detachably mounted to the base body 10 by virtue of a cooperation between the locking assembly 41 and the fastening structure 20. When the fuse 33 of the vehicle charger 100 is damaged, the front cover 40 is detached from the base body 10 by virtue of rotating the front cover 40 with the bare hands, so that the damaged fuse 33 is further changed and the whole vehicle charger 100 has no need of being thrown. Moreover, the locking assembly 41 is cooperated with the fastening structure 20, and the locking assembly 41 is assembled to and connected with the fastening structure 20 to make the front cover 40 fastened to the base body 10. As a result, the vehicle charger 100 is capable of facilitating changing the fuse 33 of the vehicle charger 100.

What is claimed is:

1. A vehicle charger, comprising:

a base body, an inside of the base body having an accommodating space penetrating through middles of a front surface and a rear surface of the base body, a front end of the base body having a fastening structure disposed in a front of the accommodating space;

a fuse accommodated in the accommodating space;

a positive pole terminal accommodated in the accommodating space, the positive pole terminal being connected with one end of the fuse;

an elastic element accommodated in the accommodating space, one end of the elastic element being connected with the other end of the fuse;

a voltage transformation unit accommodated in the accommodating space, the other end of the elastic element being connected with the voltage transformation unit, the voltage transformation unit being connected with the positive pole terminal by virtue of the fuse and the elastic element being connected between the voltage transformation unit and the positive pole terminal, the voltage transformation unit being connected with the fuse by virtue of the elastic element;

a negative connecting component accommodated in the accommodating space, the negative connecting component being electrically connected with the voltage transformation unit; and a front cover detachably mounted to the base body, the fastening structure being matched with the front cover, and the fastening structure being assembled and connected with the front cover, one end of the front cover for connecting with the base body having a locking assembly, the locking assembly cooperating with and being buckled with the fastening structure, the front cover being assembled to the front end of the base body for sealing the accommodating space.

2. The vehicle charger as claimed in claim 1, wherein the negative connecting component is of a U shape, a mouth of the negative connecting component faces frontward, two opposite sides of the negative connecting component are arched oppositely outward, the fuse and the elastic element are located between the two opposite sides of the negative connecting component.

3. The vehicle charger as claimed in claim 1, wherein free ends of two opposite sides of the negative connecting component extend frontward to form two blocking pieces, the two blocking pieces are blocked by and buckled in inner surfaces of the front end of the base body which is of a hollow barrel shape.

4. The vehicle charger as claimed in claim 1, wherein the base body is divided into an upper shell, and a lower shell disposed under the upper shell and matched with the upper shell, the upper shell is fastened on the lower shell, and the accommodating space is formed between the upper shell and the lower shell, top surfaces of two sides of a front of the lower shell are recessed downward to form a first lower notch and a second lower notch, bottom surfaces of two sides of a front of the upper shell are recessed upward to form a first upper notch and a second upper notch, the first lower notch is combined with the first upper notch to form a first opening communicated with the accommodating space, and the second lower notch is combined with the second upper notch to form a second opening communicated with the accommodating space, two opposite sides of the negative connecting component project out of the first opening and the second opening, respectively.

5. The vehicle charger as claimed in claim 4, wherein a bottom of the front of the upper shell protrudes downward to form a hollow rectangular fixing frame, a bottom, a front and a rear of the hollow fixing frame is opened freely to form a fixing groove inside the fixing frame, the elastic element is fixed in the fixing groove of the fixing frame, the other end of the elastic element is connected with the voltage transformation unit through the rear of the hollow fixing frame.

6. The vehicle charger as claimed in claim 5, wherein a bottom surface of the front of the fixing frame is arched upward to form an arc-shaped first locating groove, an upper portion of the fuse is located in the first locating groove, a top of the front of the lower shell protrudes upward to form a propping board, a middle of a top of the propping board is recessed downward to form an arc-shaped second locating groove, a lower portion of the fuse is located in the second locating groove.

7. The vehicle charger as claimed in claim 1, wherein the front cover includes a location shaft, and a cap connected around the location shaft and perpendicular to the location shaft, the front cover opens a penetrating hole penetrating through middles of the location shaft and the cap along an axial direction of the front cover, the penetrating hole is communicated with the accommodating space, the base body is of a hollow barrel shape, the fastening structure includes an isolation board connected with a front of an inner peripheral surface of the hollow barrel-shaped base body, the accommodating space is isolated from an outside space by the isolation board, the isolation board opens a through-hole penetrating through a middle of the isolation board, the location shaft is inserted into and passes through the through-hole, the location shaft is accommodated in the accommodating space through the through-hole, the cap is covered to the isolation board.

8. The vehicle charger as claimed in claim 7, wherein the positive pole terminal is exposed out of the front cover through the penetrating hole and projects beyond a front surface of the front cover, the positive pole terminal keeps being connected with the one end of the fuse by virtue of the elastic element elastically abutting against the fuse.

9. The vehicle charger as claimed in claim 7, wherein the locking assembly includes at least two buckling blocks protruded outward from a peripheral surface of the location shaft, at least two portions of an inner peripheral surface of the through-hole are recessed outward away from the through-hole to form at least two guiding channels penetrating through a front surface and a rear surface of the isolation board, and matched with the at least two buckling blocks, the location shaft is inserted into the through-hole by virtue of the at least two buckling blocks being corresponding to and passing through the at least two guiding channels, the at least two buckling blocks are deviated from the at least two guiding channels by virtue of rotating the front cover, so that the at least two buckling blocks are buckled to a rear surface of the isolation board, after the location shaft passes through the through-hole to be inserted into the accommodating space, the front cover is buckled to and connected with the front end of the base body.

10. The vehicle charger as claimed in claim 9, wherein the locking assembly includes at least two fixing pillars protruded rearward from a rear surface of the cap facing the isolation board, at least two sides of a front surface of the isolation board are recessed rearward to form at least two arc-shaped sliding slots, an inner side wall of one end of each sliding slot adjacent to the accommodating space is stretched into each sliding slot to form a hook arc, the at least two buckling blocks are corresponding to the at least two guiding channels, the at least two fixing pillars are slidably located at the other ends of the at least two arc-shaped sliding slots away from the at least two hook arcs, so the front cover is detached from the front end of the base body, the at least two fixing pillars slide in the at least two arc-shaped sliding slots to make the at least two fixing pillars limited in the ends of the at least two sliding slots adjacent to the at least two hook arcs by the at least two hook arcs, the front cover is further fastened in the front end of the base body.

11. The vehicle charger as claimed in claim 10, wherein the locking assembly includes two buckling blocks protruded outward from two sides of a peripheral surface of the location shaft, the two buckling blocks are symmetrical to each other with respect to the location shaft, two portions of an inner peripheral surface of the through-hole are recessed oppositely to form two guiding channels matched with the two buckling blocks, the two guiding channels are symmetrical to each other with respect to a central axis of the base body.

12. The vehicle charger as claimed in claim 11, wherein the locking assembly includes two fixing pillars symmetrical to each other with respect to the location shaft, two sides of the front surface of the isolation board are recessed rearward to form two arc-shaped sliding slots symmetrical to each other with respect to the through-hole, the two hook arcs of the two sliding slots are symmetrical to each other with respect to the through-hole, the two buckling blocks are corresponding to the two guiding channels, the two fixing pillars are slidably located at the other ends of the two arc-shaped sliding slots away from the two hook arcs, so the front cover is detached from the front end of the base body, the two fixing pillars slide in the two arc-shaped sliding slots to make the two fixing pillars limited in the two ends of the two sliding slots adjacent to the two hook arcs by the two hook arcs, the front cover is further fastened in the front end of the base body.

13. The vehicle charger as claimed in claim 11, wherein the location shaft is inserted into the through-hole by virtue of the two buckling blocks being corresponding to and passing through the two guiding channels, after the location shaft passes through the through-hole to be inserted into the accommodating space, the two buckling blocks are deviated from the two guiding channels by virtue of rotating the front cover, so that the two buckling blocks are buckled to a rear surface of the isolation board, and the front cover is buckled to and connected with the front end of the base body.

14. The vehicle charger as claimed in claim 11, wherein the front cover is flexibly detached from the base body by virtue of rotating the front cover to make the at least two buckling blocks be corresponding to the at least two guiding channels, so that the fuse is facilitated for being changed.

15. The vehicle charger as claimed in claim 14, wherein after the fuse is changed, the two buckling blocks are deviated from the two guiding channels by virtue of rotating the front cover, the two buckling blocks are further buckled to a rear surface of the isolation board, and the front cover is buckled to and connected with the front end of the base body.

16. A vehicle charger, comprising:

an upper shell;

a lower shell disposed under the upper shell and matched with the upper shell, the upper shell being fastened on the lower shell, and an accommodating space being formed between the upper shell and the lower shell, the accommodating space penetrating through middles of front surfaces and rear surfaces of the upper shell and the lower shell;

a fastening structure disposed in a front of the accommodating space;

a fuse accommodated in the accommodating space;

a positive pole terminal accommodated in the accommodating space, the positive pole terminal being connected with one end of the fuse;

an elastic element accommodated in the accommodating space, one end of the elastic element being connected with the other end of the fuse;

a voltage transformation unit accommodated in the accommodating space, the other end of the elastic element is connected with the voltage transformation unit, the voltage transformation unit being connected with the positive pole terminal by virtue of the fuse and the elastic element being connected between the voltage transformation unit and the positive pole terminal, the voltage transformation unit being connected with the fuse by virtue of the elastic element;

a negative connecting component accommodated in the accommodating space, the negative connecting component being electrically connected with the voltage transformation unit; and a front cover detachably mounted to the upper shell and the lower shell, the fastening structure being matched with the front cover, and the fastening structure being assembled and connected with the front cover, one end of the front cover for connecting with the upper shell and the lower shell, having a locking assembly, the locking assembly cooperating with and being buckled with the fastening structure, the front cover being assembled to front ends of the upper shell and the lower shell for sealing the accommodating space.

17. A vehicle charger, comprising:

a base body, an inside of the base body having an accommodating space penetrating through middles of a front surface and a rear surface of the base body, a front end of the base body having a fastening structure disposed in a front of the accommodating space;

a fuse accommodated in the accommodating space;

a positive pole terminal accommodated in the accommodating space, the positive pole terminal being connected with one end of the fuse;

an elastic element accommodated in the accommodating space, one end of the elastic element being connected with the other end of the fuse;

a voltage transformation unit accommodated in the accommodating space, the other end of the elastic element is connected with the voltage transformation unit, the voltage transformation unit being connected with the positive pole terminal by virtue of the fuse and the elastic element being connected between the voltage transformation unit and the positive pole terminal, the voltage transformation unit being connected with the fuse by virtue of the elastic element;

a negative connecting component accommodated in the accommodating space, the negative connecting component being electrically connected with the voltage transformation unit; and a front cover detachably mounted to the base body, the fastening structure being matched with the front cover, and the fastening structure being assembled and connected with the front cover, one end of the front cover for connecting with the base body having a locking assembly, the locking assembly cooperating with and being buckled with the fastening structure, the front cover being assembled to the front end of the base body for sealing the accommodating space;

wherein the front cover includes a location shaft, the front cover opens a penetrating hole penetrating through a middle of the front cover along an axial direction of the front cover, the penetrating hole is communicated with the accommodating space, the base body is of a hollow barrel shape, the fastening structure includes an isolation board connected with a front of an inner peripheral surface of the hollow barrel-shaped base body, the isolation board opens a through-hole penetrating through a middle of the isolation board, the location shaft is accommodated in the accommodating space through the through-hole, the locking assembly includes at least two buckling blocks protruded outward from a peripheral surface of the location shaft, at least two portions of an inner peripheral surface of the through-hole are recessed outward away from the through-hole to form at least two guiding channels penetrating through a front surface and a rear surface of the isolation board, and matched with the at least two buckling blocks, the location shaft is inserted into the through-hole by virtue of the at least two buckling blocks being corresponding to and passing through the at least two guiding channels, the at least two buckling blocks are deviated from the at least two guiding channels by virtue of rotating the front cover, so that the at least two buckling blocks are buckled to a rear surface of the isolation board, and the front cover is buckled to and connected with the front end of the base body, the front cover is flexibly detached from the base body by virtue of rotating the front cover to make the at least two buckling blocks be corresponding to the at least two guiding channels.

18. The vehicle charger as claimed in claim 17, wherein the front cover includes a cap connected around the location shaft and perpendicular to the location shaft, the locking assembly includes at least two fixing pillars protruded rearward from a rear surface of the cap facing the isolation board, at least two sides of the front surface of the isolation board are recessed rearward to form at least two arc-shaped sliding slots, an inner side wall of one end of each sliding slot adjacent to the accommodating space is stretched into each sliding slot to form a hook arc, the at least two buckling blocks are corresponding to the at least two guiding channels, the at least two fixing pillars are slidably located at the other ends of the at least two arc-shaped sliding slots away from the at least two hook arcs, so the front cover is detached from the front end of the base body, the at least two fixing pillars slide in the at least two arc-shaped sliding slots to make the at least two fixing pillars limited in the ends of the at least two sliding slots adjacent to the at least two hook arcs by the at least two hook arcs, the front cover is further fastened in the front end of the base body.

19. The vehicle charger as claimed in claim 18, wherein the locking assembly includes two buckling blocks protruded outward from two sides of a peripheral surface of the location shaft, the two buckling blocks are symmetrical to each other with respect to the location shaft, two portions of an inner peripheral surface of the through-hole are recessed oppositely to form two guiding channels matched with the two buckling blocks, the two guiding channels are symmetrical to each other with respect to a central axis of the base body, the location shaft is inserted into the through-hole by virtue of the two buckling blocks being corresponding to and passing through the two guiding channels, after the location shaft passes through the through-hole to be inserted into the accommodating space, the two buckling blocks are deviated from the two guiding channels by virtue of rotating the front cover, so that the two buckling blocks are buckled to the rear surface of the isolation board, and the front cover is buckled to and connected with the front end of the base body.

20. The vehicle charger as claimed in claim 19, wherein the locking assembly includes two fixing pillars symmetrical to each other with respect to the location shaft, two sides of the front surface of the isolation board are recessed rearward to form two arc-shaped sliding slots symmetrical to each other with respect to the through-hole, the two hook arcs of the two sliding slots are symmetrical to each other with respect to the through-hole, the two buckling blocks are corresponding to the two guiding channels, the two fixing pillars are slidably located at the other ends of the two arc-shaped sliding slots away from the two hook arcs, so the front cover is detached from the front end of the base body, the two fixing pillars slide in the two arc-shaped sliding slots to make the two fixing pillars limited in the two ends of the two sliding slots adjacent to the two hook arcs by the two hook arcs, the front cover is further fastened in the front end of the base body.

* * * * *